US005513865A

United States Patent [19]

Brooks et al.

[11] Patent Number: 5,513,865

[45] Date of Patent: May 7, 1996

[54] SIMPLIFIED STEERING MECHANISM HAVING BOTH STEERING AND TILTING CAPABILITES

[75] Inventors: Paul F. Brooks, Sandy; Kenneth D. Lisonbee, West Jordan, all of Utah

[73] Assignee: Paul E. Brooks, Sandy, Utah

[21] Appl. No.: 277,832

[22] Filed: Jul. 19, 1994

Related U.S. Application Data

[63] Continuation-in-part of Ser. No. 93,358, Jul. 19, 1993, Pat. No. 5,330,214, which is a continuation-in-part of Ser. No. 988,868, Dec. 8, 1992, Pat. No. 5,232,235, which is a continuation-in-part of Ser. No. 754,008, Sep. 3, 1991, Pat. No. 5,169,166.

[51] Int. Cl.[6] ..... A63C 17/01

[52] U.S. Cl. ..... 280/87.042; 280/11.27; 280/112.2

[58] Field of Search ..... 280/11.19, 11.27, 280/11.28, 22.1, 87.041, 87.042, 86, 100, 111, 112.2, 688

[56] References Cited

U.S. PATENT DOCUMENTS

| | | | |
|---|---|---|---|
| 2,509,324 | 5/1950 | Van Horn | 280/11.28 |
| 3,331,612 | 7/1967 | Tietge | 280/87.042 X |
| 4,020,914 | 5/1977 | Trautwein | 280/112.2 X |
| 4,036,506 | 7/1977 | Scheib | 280/22.1 |
| 4,398,734 | 8/1983 | Barnhard | 280/11.28 |
| 4,740,000 | 4/1988 | Moessner | 280/87.042 X |
| 4,740,004 | 4/1988 | McMullen | 280/112.2 X |
| 4,998,596 | 3/1991 | Miksitz | 280/112.2 X |
| 5,040,812 | 8/1991 | Patin | 280/112.2 X |
| 5,161,810 | 11/1992 | DeCesare | 280/14.2 |

*Primary Examiner*—Margaret A. Focarino
*Assistant Examiner*—Michael Mar
*Attorney, Agent, or Firm*—Snow, Christensen & Martineau

[57] ABSTRACT

A simplified steering mechanism having both wheel steering and wheel tilting capabilities is provided. The mechanism comprises a generally planar platform, a plunger assembly attached to the bottom face of the platform, top and bottom axles of equal length, and a pair of wheels. Each axle intersects an intermediate space in the plunger assembly at an approximate midpoint, the ends of the axles being pivotally attached to the wheels when a downward vertical force is exerted on one of the longitudinal sides of the platform, the wheels tilt and turn simultaneously relative to the platform.

12 Claims, 6 Drawing Sheets

SIMPLIFIED STEERING MECHANISM HAVING BOTH STEERING AND TILTING CAPABILITES

This application is a continuation-in-part of application Ser. No. 08/093,358, now U.S. Pat. No. 5,330,214 which is a continuation-in-part of Ser. No. 07/988,868 filed Dec. 8, 1992, now U.S. Pat. No. 5,232,235, which is a continuation-in-part of Ser. No. 07/754,008 filed Sep. 3, 1991, now U.S. Pat. No. 5,169,166.

BACKGROUND

1. Field

This invention relates generally to the field of weight change responsive steering mechanisms, such as those commonly used with skateboards, and more specifically to a novel, simplified steering mechanism which offers the advantages of simultaneous steering and wheel tilting.

2. Prior Art

Steering mechanisms which respond to weight changes made by the operator/rider, usually known as trucks, are well known in the art. In most instances, trucks are attached to the bottom broad face of a platform, or similar planar member, upon which a weight rests or stands. Responsive to a change in the center of mass of the weight from one side to another, the platform tilts slightly to cause the truck to change the direction in which the corresponding wheels are pointing. Thus, a rider balanced atop a skateboard shifts his or her weight to one side or the other depending on the direction desired.

Generally, the wheels used with such trucks are relatively small in diameter, while having a relatively substantial width (the width often exceeds the diameter). Also, these wheels are usually close together, and therefore disposed underneath the platform. U.S. Pat. No. 2,509,324, issued to Van Horn in 1950, and U.S. Pat. No. 4,398,734, issued to Barnard in 1983, are typical of such trucks and wheels, and embody the typical arrangement in skateboards.

Both the Barnard and Van Horn patents disclose a plunger which is rigidly affixed at one end to the bottom face of a platform, the free end of the plunger extending downwardly therefrom. An axle having wheels rotatably attached at both ends is affixed to the free end of the plunger, the axle including a leg which extends forwardly. The forwardly extending end of the leg is in communication with a leg holder such that universal movement of the leg's free end is allowed.

In this manner, when the center of mass of a weight atop the platform is shifted to one side of the platform or the other, the platform and plunger correspondingly shift or tilt slightly, the plunger thereby causing the axle and wheels to turn in a different direction.

While adequate for a number of applications, the type of steering truck just described includes a number of disadvantages as well. For example, this configuration requires that the wheels be fairly close together. This can become a problem when the truck is called upon to make sharp turns since the platform may tilt far enough over to make contact with the wheels. Thus, this configuration not only limits the turning radius of this type of steering mechanism, but the platform contacting the wheels can cause a dangerous situation as well.

For instance, many skateboard riders lean extremely hard into sharp turns, particularly when traveling at a high rate of speed. When this happens, it is not only conceivable, but probable, that the exertion of such a force on the edge of the skateboard platform will cause a tilting of the platform with respect to the wheels such that the platform and wheels come in contact, thereby throwing the rider off balance and probably causing an accident. Also, if the platform can come into contact with the wheels during such a turn, undue wear and tear is caused on both the wheels and the platform.

Another problem caused by the configuration mentioned above is the size of the wheels. While providing a greater contact area with the ground, such wheels cannot tilt into a turn to assist in gripping the ground surface. Indeed, even assuming that such steering mechanisms provide for tilt in the wheels, which they do not, the extra wide wheels commonly used on skateboards could not be tilted during a turning maneuver without virtually eliminating the ground contact sought to be maintained by use of the wide wheels. Thus, without the ability to tilt, horizontal forces experienced during the course of a turn, caused by the tendency of an object to travel in straight path, must be completely absorbed by frictional forces between the wheels and the ground.

Furthermore, Applicant's prior applications dealing with steering mechanisms which have both steering and tilting capabilities are fairly complex. Hence, the steering mechanisms covered by these applications can be more expensive than desired, and may tend to break down and be more difficult to repair and maintain.

Therefore, there exists in the prior art a legitimate need for a steering mechanism which not only provides steering capabilities, but also provides tilting capabilities as well to allow enhanced turning capacity. Further, a steering mechanism which provides these capabilities and which is constructed in a simpler fashion is even more desirable.

BRIEF SUMMARY AND OBJECTS OF THE INVENTION

In view of the above described state of the art, the present invention seeks to realize, among other things the following objects and advantages.

A principal object of the present invention is to provide a novel steering mechanism which combines steering capabilities with tilting capabilities.

A further important object of the present invention is to provide a steering mechanism which is controlled by the transfer of weight about various points on a platform, said platform tilting slightly in response to the transfer of weight.

Another major object of the invention is to provide a steering mechanism controlled by weight transfer about a platform wherein the platform cannot come in contact with the wheels.

Yet another principal object of the invention is the provision of a steering mechanism which includes wheels having increased rotating capacity relative to the ground due to decreased friction.

Still another principal object of the present invention is to provide a high performance steering mechanism for use with skateboards which allow safer travel at high speeds due to a wider wheel base and an increased turning capability due to tilting wheels.

It is a further object of the invention to provide a steering mechanism which is efficient, durable, easily assembled, lightweight, easily manufactured and safe.

These and other objects and advantages of the invention will become more fully apparent from the description and claims which follow, or may be learned by the practice of the invention.

Accordingly, the steering mechanism of the present invention comprises generally a platform, a plunger assembly, top and bottom axles, and a pair of wheels. At present preference, the platform includes top and bottom broad faces, as well as first and second longitudinal sides.

The plunger assembly advantageously comprises an attachment plate whereby the platform is rigidly attached to the plunger assembly at the bottom broad face thereof. The plunger assembly further comprises first and second downwardly extending parallel plunger portions which define an intermediate space. Preferably, the top and bottom axles are of equal length, and each axle intersects the intermediate space defined by the first and second corresponding plungers at an approximate midpoint.

As one skilled in the art will recognize, one end of both the top and bottom axles are hingedly connected to one of the wheels while the other end of both the top and bottom axles are hingedly connected to the other wheel. In this fashion, a downward vertical force may be exerted on either of the longitudinal sides of the platform, thereby causing the wheels to tilt and turn simultaneously relative to the platform.

Further, both the top and bottom axles are pivotally connected to at least one of the downwardly extending corresponding plungers at the approximate midpoint. Importantly, the top axle includes a first steering pin which extends downwardly and towards the first plunger in the intermediate space. Similarly, the bottom axle includes a second steering pin which extends upwardly and towards the second plunger in the intermediate space. Advantageously, one or both of the plungers further defines an interior space adjacent to an opening into the intermediate space. This interior space or spaces is filled by a cushioned material having memory. One skilled in the art will recognize that the cushioned material comprises flexing means for returning and maintaining the mechanism in a neutral position when the longitudinal sides of the platform are not acted upon by a downward vertical force. In the preferred embodiment, the cushioned material surrounds the pivotal connections of the top and bottom axles in the intermediate space.

It will be recognized that the wheel tilting capabilities of the present invention are enhanced when the distance between the top and bottom axles is greater at the approximate midpoints thereof than at the respective ends. Each currently preferred wheel comprises a non-rotating, tilting hub to which the top and bottom axles are pivotally connected, a bearing, and a tire. The preferred bearing has rotating and non-rotating portions, the non-rotating portion being fit over the hub, and the tire being fit over the rotating portion of the bearing. In a second embodiment, each wheel comprises a spindle, a tire, a hub, and at least one bearing to facilitate rotation of the tire. The spindle may include a pivoting connection portion and an axle portion, the pivoting connection portion including a top aperture and a bottom aperture. The top aperture is adapted for pivotal connection, preferably a pin connection, to an end of the top axle and the bottom aperture is adapted for similar pivotal connection to an end of the bottom axle. Both a tire and a hub are rotatably mounted on the axle portion of the spindle, and the one or more bearings facilitate rotation of the tire about the axle portion of the spindle. Means may be provided for retaining the tire, hub and at least one bearing in position, such means comprising a threaded end on the axle portion of the spindle and a corresponding nut.

In its most common usage, a skateboard assembly for recreation and competitive use is created by attaching a pair of identical, but oppositely disposed, steering mechanisms to the bottom broad face of generally planar platform. In this manner, when a downward vertical force is exerted on one of the longitudinal sides of the platform, the wheels tilt and turn simultaneously relative to the platform.

BRIEF DESCRIPTION OF DRAWINGS

In order that the manner in which the above recited and other advantages and objects of the invention are obtained can be appreciated, a more specific description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DESCRIPTION OF THE PREFERRED EMBODIMENT

Figure 1:
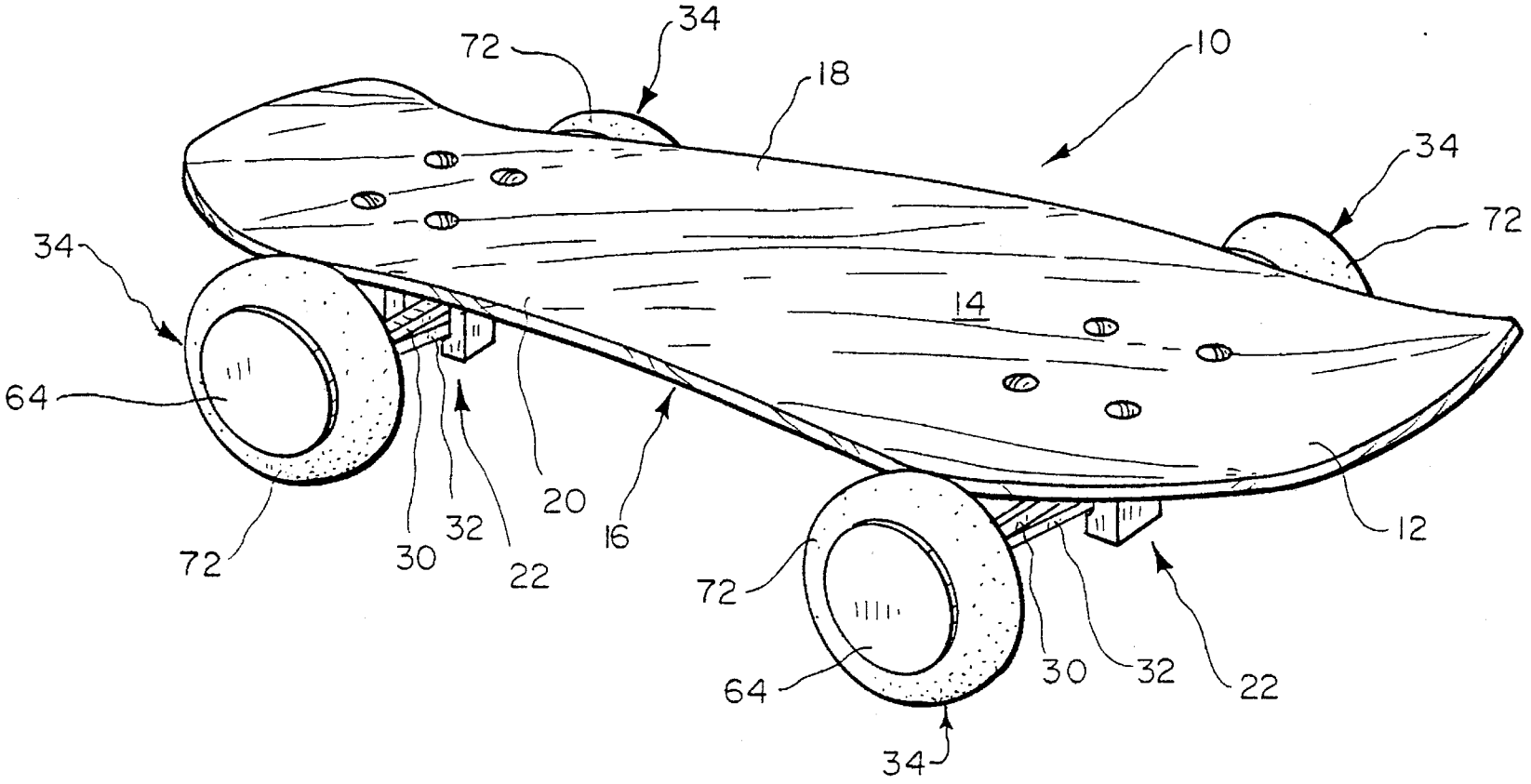
FIG. 1 is a front perspective view of the preferred embodiment of the present invention, as used on a conventional skateboard application, illustrating both steering and tilting capabilities.
Figure 2:
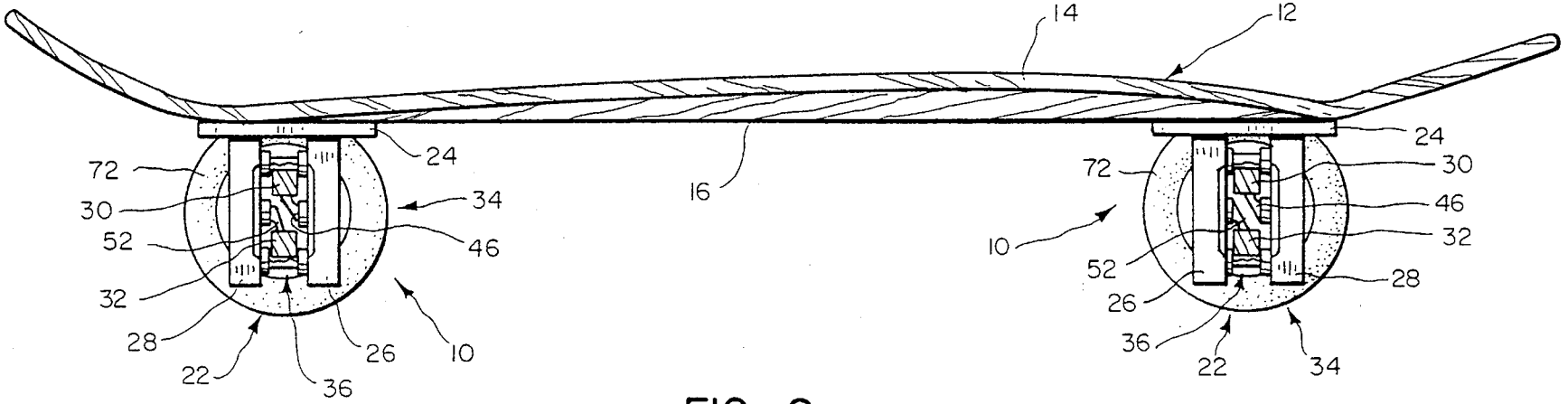
FIG. 2 is a side elevational view of the embodiment of FIG. 1.
Figure 3:
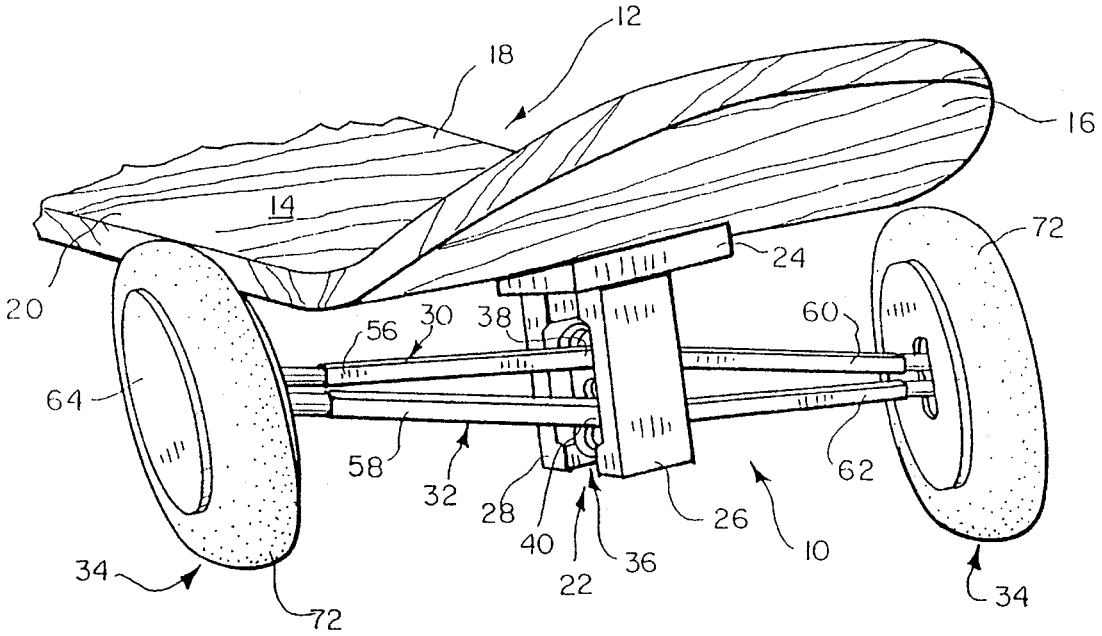
FIG. 3 is partial front perspective view of the embodiment of FIG. 1 illustrating both steering and tilting capabilities.

Reference is now made to the drawing wherein like numerals are used to designate like components throughout. The presently preferred steering mechanism, generally designated 10, comprises a platform 12, a plunger assembly 22, top and bottom axles 30 and 32, respectively, and a pair of wheels 34. Each of these components will be described in greater detail hereafter.

The platform 12 is preferably a rigid, generally planar member which may take a variety of different shapes. One preferred shape thereof is substantially rectangular such as may be used in conjunction with a skateboard. One skilled in the art will recognize that the shape of the platform 12 is best determined by the desired use of the steering mechanism 10.

Advantageously, platform 12 is constructed of a substantially rigid material such as wood or plastic. Other materials, such as wood composites, steel, aluminum, and the like, are also contemplated and fall within the purview of this invention.

Platform 12 includes top and bottom broad faces 14 and 16, respectively. When used in conjunction with a skateboard, the top broad face 14 accommodates an operator, who stands thereon during operation. When used for other applications, any weight to be carried by the steering mechanism 10 is normally carried on the top broad face 14 of the platform 12. Additionally, it is on the top face 14 that an operator may directly or indirectly exert a downward vertical force on one of the two longitudinal sides 18 and 20 of the platform 12, thereby causing the wheels 34 to tilt and turn simultaneously relative to the platform 12, as explained hereinafter. This downward vertical force, in the case of a skateboard, is normally exerted directly by the operator, who makes a weight shift towards or away from one of the longitudinal sides 18 or 20.

Plunger assembly 22, at present preference, includes an attachment plate 24 and first and second downwardly extending, parallel plunger portions 26 and 28, respectively. In this configuration, the plunger portions 26 and 28 define an intermediate space 36 between said portions. As discussed hereafter, the top and bottom axles 30 and 32 intersect the intermediate space 36 at an approximate midpoint 38 and 40, respectively. Advantageously, both the top and bottom axles 30 and 32 are pivotally connected to at least one of the downwardly extending corresponding plungers 26 or 28. Pivot pins 42 and 44, respectively, affixed to the midpoints 38 and 40, respectively, of the top and bottom axles 30 and 32, respectively, are pivotally connected to at least one of the downwardly extending corresponding plungers 26 or 28.

Top axle 30 further includes a first steering pin 46 which extends upwardly and towards the second plunger 28 in the intermediate space 36. Preferably, the first plunger 26 defines an interior space 48 adjacent to and opening into the intermediate space 36. The pivot pin 42 is connected to the first plunger 26 within the interior space 48 and also is adapted to receive the first steering pin 46. In order to return and maintain the steering mechanism 10 in a neutral position when the longitudinal sides 18 and 20 of the platform 12 are not acted upon by a downward vertical force, the interior space 48 is preferably filled by a cushioned material 50, such as a hardened rubber or similar, which has memory.

Similarly, the bottom axle 32 includes a second steering pin 52 which extends upwardly and towards the second plunger 28 in the intermediate space 36. Second plunger 28 further includes an interior space 54 adjacent to and opening into the intermediate space 36. The pivot pin 44 is connected to the second plunger 28 within the interior space 54 and also is adapted to receive the second steering pin 52. In order to return and maintain the steering mechanism 10 in a neutral position when the longitudinal sides 18 and 20 of the platform 12 are not acted upon by a downward vertical force, the interior space 54 is preferably filled by the same cushioned material 50 as is used to fill the interior space 48. One skilled in the art will recognize that the cushioned material 50 comprises flexing means for returning and maintaining the mechanism in a neutral position. Advantageously, the cushioned material 50 surrounds the pivot pins 42 and 44 at the connection points of the top and bottom axles 30 and 32, respectively.

Figure 4:
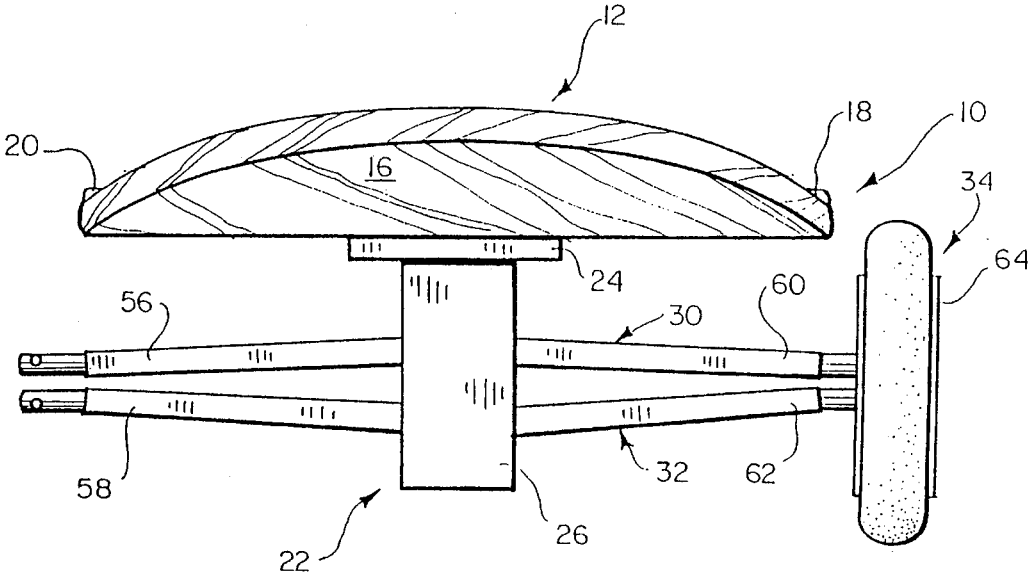
FIG. 4 is a partial front elevational view of the embodiment of FIG. 1.
Figure 5:
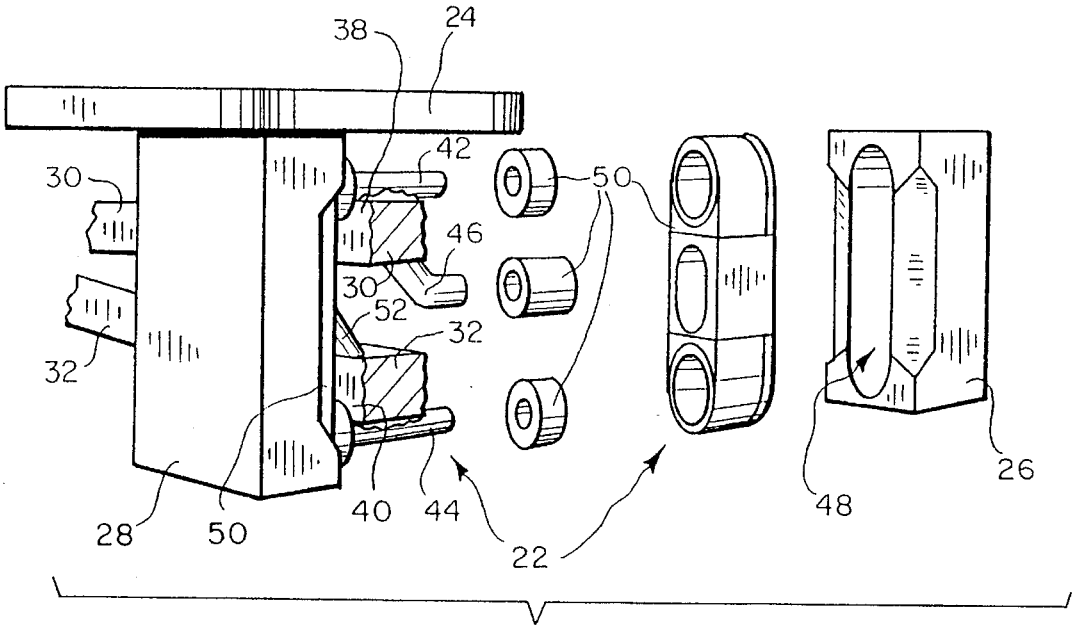
FIG. 5 is a partial exploded perspective view of the preferred plunger assembly of the embodiment of FIG. 1.
Figure 6:
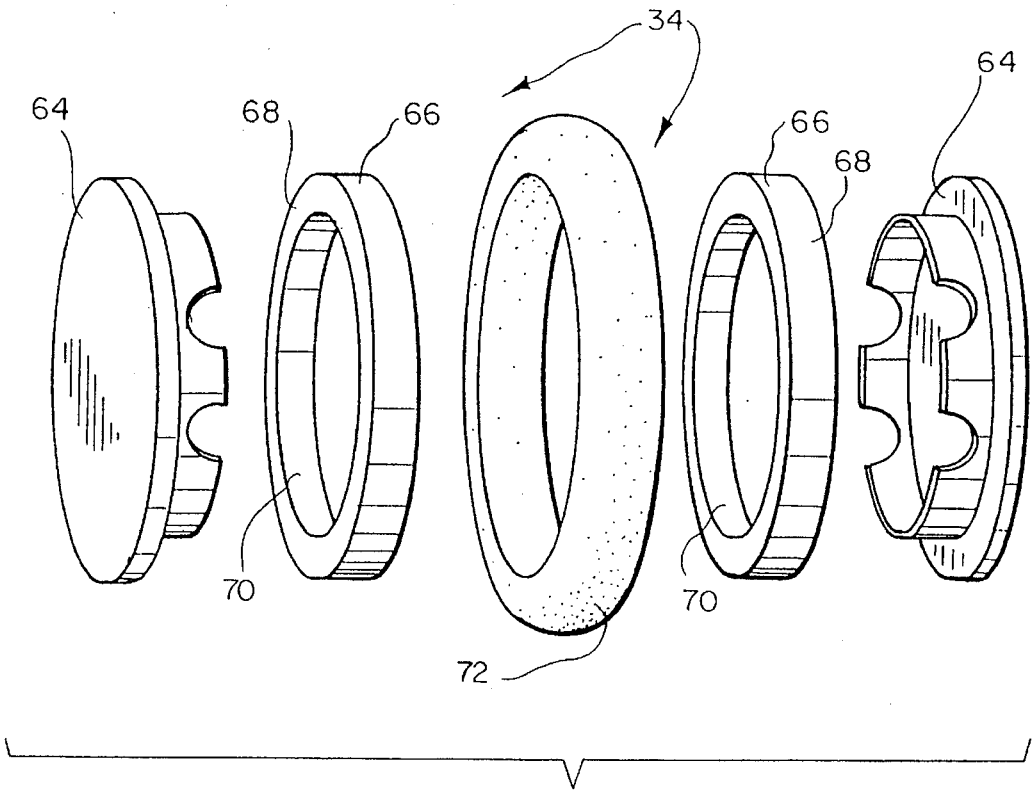
FIG. 6 is an exploded perspective view of the preferred wheel assembly, according to the present invention.

It is preferred that the top and bottom axles 30 and 32 are of equal length and that each include a first end 56 and 58, respectively, and a second end 60 and 62, respectively. As best shown in FIG. 4, the distance between the top axle 30 and bottom axle 32 is greater at the respective midpoints 38 and 40 thereof than at the respective ends 56 and 58 or 60 and 62. This configuration enhances the tilting capabilities of the mechanism 10, such that the greater the distance between the respective midpoints 38 and 40, the lesser the amount of tilt of the platform 12 is required to obtain a given amount of tilt of the wheels 34.

Each wheel 34 preferably comprises a non-rotating, tilting hub 64 to which the top and bottom axles 30 and 32 are pivotally connected, a bearing 66 including a rotating portion 68, a non-rotating portion 70 and a tire 72. The non-rotating portion 70 of the bearing 66 fits snugly over the hub 64 and a tire 72 fits snugly over the rotating portion 68 of the bearing 66.

Figure 10:
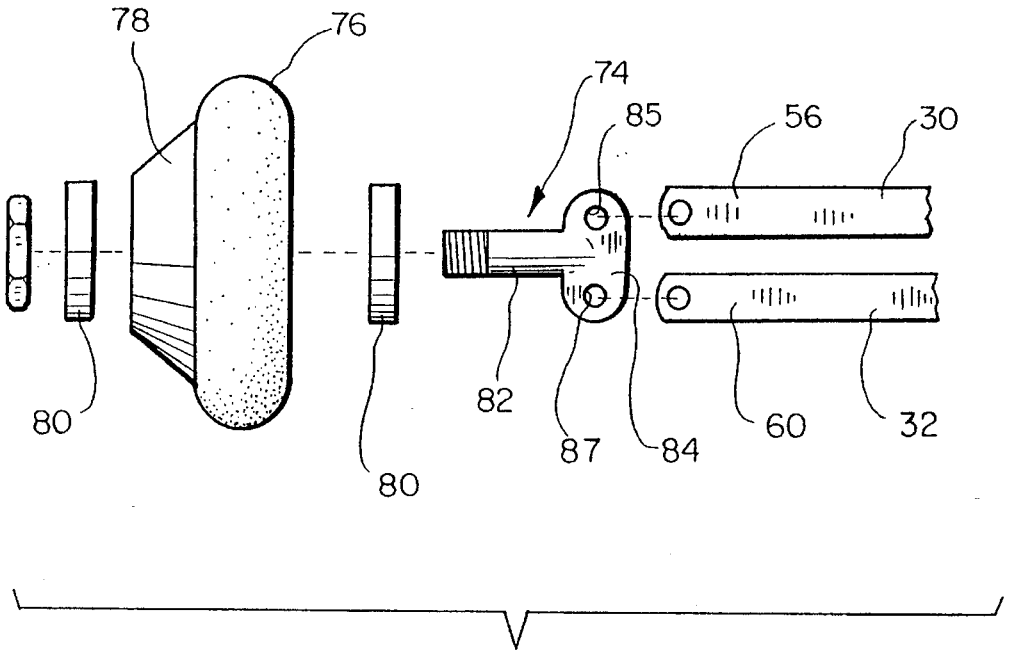
FIG. 10 is an exploded view of a second embodiment of the preferred wheel assembly.

FIG. 10 illustrates a second embodiment of a preferred wheel 34 which comprises a spindle 74, a tire 76, a hub 78 and at least one bearing 80 to facilitate rotation of the tire 76 about the spindle 74. The spindle includes a pivoting connection portion 82 and an axle portion 84, pivoting connection portion 82 including a top aperture 85 and a bottom aperture 87. The top aperture 85 is adapted for pivotal connection to an end of the top axle 30 and a bottom aperture 87 is adapted for pivotal connection to an end of the bottom axle 32. As one skilled in the art will recognize a tire 76 and hub 78 are rotatably mounted on the axle portion 84 of the spindle 74.

Figure 7:
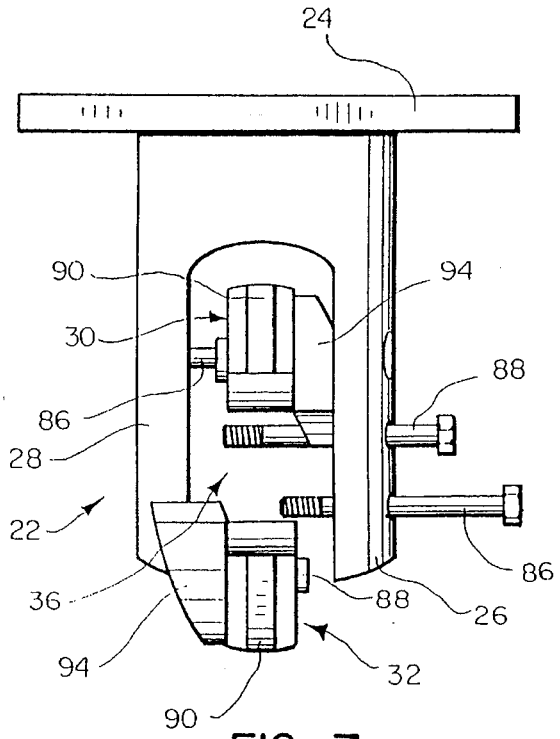
FIG. 7 is a partial side elevational view of a second embodiment of the present invention.
Figure 8:
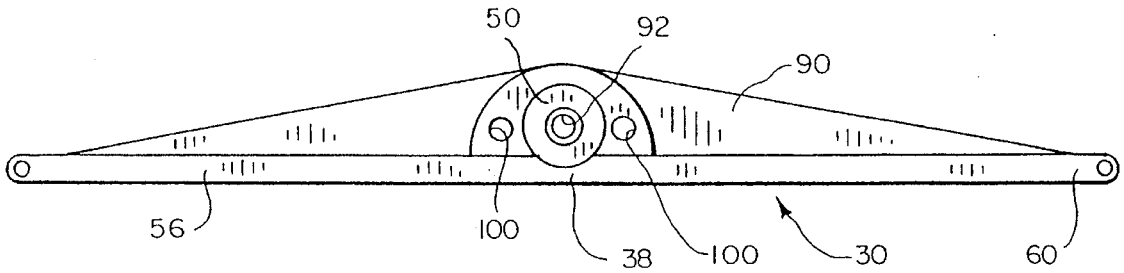
FIG. 8 is a front elevational view of the top axle of the embodiment of FIG. 7.
Figure 9:
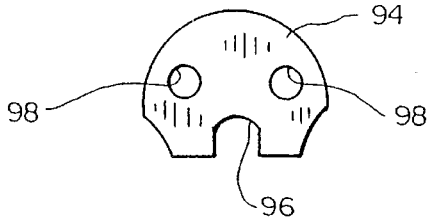
FIG. 9 is a steering plate for use in the embodiment of FIG. 7.

FIGS. 7 through 9 illustrate a second preferred plunger assembly which provides the added advantage of adjustable tilting and adjustable steering. In other words, a first positioning screw 86 provides a means whereby the tilting capabilities of the mechanism may be altered according to need and desire. A second positioning screw 88 provides a similar function for the steering capabilities.

As one skilled in the art will recognize, the first positioning screw 86 effects the amount of tilt the axles are allowed to experience by loosening or tightening the hinged connection of at least one of the axles to the plungers. Similarly, the second positioning screw 88 effects the amount of steering the axles are allowed to experience.

In the embodiment of FIGS. 7 through 9, the axles 30 and 32 preferably comprise a reinforcement portion 90 comprising a central aperture 92 through which the first positioning screw 86 passes. Surrounding the aperture 92 is cushioned material 50 having memory and allowing for rebound. In this preferred embodiment, a steering plate 94, shown in FIG. 9, aids in the adjustable steering process. As illustrated, the second positioning screw 88 passes through a notch 96 to force the axles out of horizontal alignment with the platform 12 when a vertical force is exerted against one of the two longitudinal sides 18 or 20 of the platform 12.

Referring now to FIG. 7, one skilled in the art will recognize that the effective distance of the steering plate 94 from the vertical midline of the internal space 36 will determine the amount of steering realized by the mechanism 10. Thus, replacement of the steering plate 94 with a thicker or thinner plate 94 will decrease or increase, respectively, the amount of steering experienced.

Further, it is to be recognized that the steering plate 94 is secured to the reinforcement portion 90 of each axle 30 or 32 in a conventional manner. This may include, as shown, corresponding apertures 98 and 100 in the axle 30 or 32 and steering plate 94, respectively, through which screws or bolts, not shown, pass. One skilled in the art will recognize that this structure comprises steering adjusting means in the steering mechanism 10. However, it will be recognized that many other similar structures, such as cartridges, dials and clips serve the same function and fall within the scope of this invention.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A simplified steering mechanism having both wheel steering and wheel tilting capabilities, comprising:

a generally planar platform having top and bottom broad faces and having first and second longitudinal sides, a plunger assembly including an attachment plate attached to the bottom broad face of the platform, first and second parallel plunger portions rigidly attached to the plate and extending downwardly therefrom, the plunger portions defining a vertical intermediate space therebetween, top and bottom axles of equal length, each axle intersecting the intermediate space at an approximate midpoint and each axle including first and second ends, said plunger assembly including a pivot pin and a steering pin for pivotally securing each axle to the plunger assembly and flexing means for returning and maintaining the axles in a neutral steering position, a pair of wheels, the top and bottom axles having first ends hingedly connected to one wheel and the top and bottom axles having second ends hingedly connected to the other wheel, wherein a downward vertical force exerted upon one of the longitudinal sides of the platform would cause the axles to pivot relative to the plunger assembly and the wheels to tilt and turn relative to the platform.

2. A simplified steering mechanism having both wheel steering and wheel tilting capabilities according to claim 1, wherein the top axle includes a first steering pin extending downwardly and towards the first plunger in the intermediate space.

3. A simplified steering mechanism having both wheel steering and wheel tilting capabilities according to claim 1, wherein the bottom axle includes a second steering pin extending upwardly and towards the second plunger in the intermediate space.

4. A simplified steering mechanism having both wheel steering and wheel tilting capabilities according to claim 1, wherein at least one of the plungers defines an interior space adjacent to and opening into the intermediate space, the interior space being filled by a cushioned material having memory.

5. A simplified steering mechanism having both wheel steering and wheel tilting capabilities according to claim 1, wherein the cushioned material surrounds pivotal connections between the plunger and the top and bottom axles.

6. A simplified steering mechanism having both wheel steering and wheel tilting capabilities according to claim 1, wherein the axles are of such a length that the wheels remain out of contact with the platform upon exertion of a downward vertical force on one of the longitudinal sides of the platform.

7. A simplified steering mechanism having both wheel steering and wheel tilting capabilities according to claim 1, wherein the distance between the top and bottom axles is greater at the approximate mid points than at the respective ends to enhance tilting capabilities of the mechanism.

8. A simplified steering mechanism having both wheel steering and wheel tilting capabilities according to claim 1, wherein the flexing means comprises a cushioned material.

9. A simplified steering mechanism having both wheel steering and wheel tilting capabilities according to claim 1, wherein each wheel comprises a non-rotating, tilting hub to which the top and bottom axles are pivotally connected, a bearing having rotating and non-rotating portions, the non-rotating portion being fitted over the hub, and a tire, the tire being fitted over the rotating portion of the bearing.

10. A simplified steering mechanism having both wheel steering and wheel tilting capabilities according to claim 1, wherein each wheel comprises a spindle, the spindle including a pivoting connection portion and an axle portion, the pivoting connection portion including a top aperture and a bottom aperture, the top aperture being adapted for pivotal connection to the an end of the top axle and the bottom aperture being adapted for pivotal connection to an end of the bottom axle, a tire rotatably mounted on the axle portion of the spindle, a hub rotatably mounted on the axle portion of the spindle, and at least one bearing to facilitate rotation of the tire about the axle portion of the spindle.

11. A simplified steering mechanism having both wheel steering and wheel tilting capabilities according to claim 10, further comprising means for retaining the tire, hub and at least one bearing in position.

12. A skateboard assembly for recreational and competitive use, comprising:

a generally planar platform having top and bottom broad faces and having first and second longitudinal sides, and a pair of identical, but oppositely disposed steering mechanisms, each steering mechanism comprising:

a plunger assembly including an attachment plate attached to the bottom broad face of the platform, first and second parallel plunger portions rigidly attached to the plate and extending downwardly therefrom, the plunger portions defining a vertical intermediate space therebetween, top and bottom axles of equal length, each axle intersecting the intermediate space at an approximate midpoint and each axle including first and second ends, said plunger assembly including a pivot pin and a steering pin for pivotally securing each axle to the plunger assembly and flexing means for returning and maintaining the axles in a natural steering position, a pair of wheels, the top and bottom axles having first ends hingedly connected to one wheel and the top and bottom axles having second ends hingedly connected to the other wheel, wherein a downward vertical force exerted upon one of the longitudinal sides of the platform would cause the axles to pivot relative to the plunger assembly and the wheels to tilt and turn relative to the platform.

* * * * *